US006240774B1

(12) United States Patent
Niki et al.

(10) Patent No.: US 6,240,774 B1
(45) Date of Patent: Jun. 5, 2001

(54) SYSTEM FOR DETECTING MALFUNCTION OF INTERNAL COMBUSTION ENGINE RADIATOR

(75) Inventors: Manabu Niki; Takashi Isobe; Yuzuru Koike; Akira Hashimoto, all of Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/335,917

(22) Filed: Jun. 18, 1999

(30) Foreign Application Priority Data

Jun. 19, 1998 (JP) ..... 10-188104

(51) Int. Cl.[7] ..... G01M 15/00
(52) U.S. Cl. ..... 73/118.1; 123/41.01; 340/449
(58) Field of Search ..... 73/116, 117.2, 73/117.3, 118.1, 119 R; 340/438, 449, 450, 450.3; 123/41.01

(56) References Cited

U.S. PATENT DOCUMENTS 4,069,712 * 1/1978 Armstrong et al. ..... 73/118.1
4,682,493 * 7/1987 Tenenbaum ..... 73/118.1
5,018,484 * 5/1991 Naitoh .
5,521,581 * 5/1996 Prouix .
5,526,871 * 6/1996 Musser et al. ..... 73/117.3
5,656,771 * 8/1997 Beswick et al. ..... 73/118.1
5,708,412 * 1/1998 Prouix .
5,738,049 * 4/1998 Ninomiya .

FOREIGN PATENT DOCUMENTS 6-213117 8/1994 (JP) .

* cited by examiner

*Primary Examiner*—Eric S. McCall
(74) *Attorney, Agent, or Firm*—Arent Fox Kintner Plotkin & Kahn, PLLC

(57) ABSTRACT

A system for detecting malfunction of a radiator, more precisely a thermostat (shut-off valve) in the engine cooling system. In the system, an estimated coolant temperature CTW is calculated from the temperature condition and operating condition at engine starting. When the estimated coolant temperature CTW has reached a judge malfunction value CTWJUD but the detected coolant temperature TW has not reached a judge normal value TWJUD, the thermostat 64 is discriminated to have malfunctioned, thereby enabling to detect malfunction of the radiator with high accuracy and high response.

20 Claims, 9 Drawing Sheets

SYSTEM FOR DETECTING MALFUNCTION OF INTERNAL COMBUSTION ENGINE RADIATOR

BACKGROUND OF THE INVENTION

1. Field of the Invention

This invention relates to a system for detecting or discriminating malfunction of an internal combustion engine radiator, more particularly to a system for detecting or discriminating malfunction of a thermostat in a cooling system of an internal combustion engine.

2. Description of the Related Art

The internal combustion engine of a vehicle is connected through a communicating passage with a radiator for cooling a coolant. A thermostat (a shut-off valve) is installed in the communicating passage. The thermostat closes the communicating passage when the coolant temperature is low, such as at engine starting, and opens it when the temperature rises so as to pass coolant into the radiator for cooling.

The radiator is one of the on-board components of a vehicle. The ability to detect or discriminate radiator malfunction is therefore desirable. For example, Japanese Laid-open Patent Application No. Hei 6(1994)-213117, which relates to a radiator equipped with a thermally insulated tank for storing coolant heated during ordinary operation, teaches a system that detects the coolant temperature at engine starting and determines that the thermally insulated tank is out of order when the detected temperature is abnormally low.

This earlier system can also determine when the thermostat is stuck closed or stuck open based on abnormally high or low detected coolant temperature during normal engine operation.

However, the ability of this conventional system to detect thermostat malfunction is limited to times when the detected coolant temperature is abnormal. It therefore does not provide satisfactory detection accuracy and response.

SUMMARY OF THE INVENTION

The object of this invention is therefore to overcome this drawback of the prior art and for this to provide a system for detecting or discriminating malfunction of an internal combustion engine radiator, capable of high-accuracy, high-response detection of radiator malfunction, particularly of malfunction of a thermostat incorporated in a radiator.

To achieve this object, the invention provides a system for detecting malfunction of an internal combustion engine radiator comprising: engine operating condition detecting means for detecting operating conditions of the engine including at least a coolant temperature; engine-start-time coolant temperature determining means for determining an engine-start-time coolant temperature at starting of the engine based on at least the detected coolant temperature; thermal load parameter determining means for determining a parameter indicative of thermal load contributing to a rise of the coolant temperature based on the detected engine operating conditions; estimated coolant temperature calculating means for calculating an estimated coolant temperature based on at least the determined engine-start-time coolant temperature and the determined parameter indicative of thermal load; and radiator malfunction discriminating means for comparing the detected coolant temperature and the calculated estimated coolant temperature with predetermined values respectively and for discriminating whether the radiator malfunctions based results of comparison.

BRIEF EXPLANATION OF THE DRAWINGS

These and other objects and advantages of the invention will be made more apparent with the following description and drawings, in which.

DETAILED DESCRIPTION OF THE PREFERRED EMBODIMENTS

An embodiment of the invention will now be explained with reference to the attached drawings.

Figure 1:
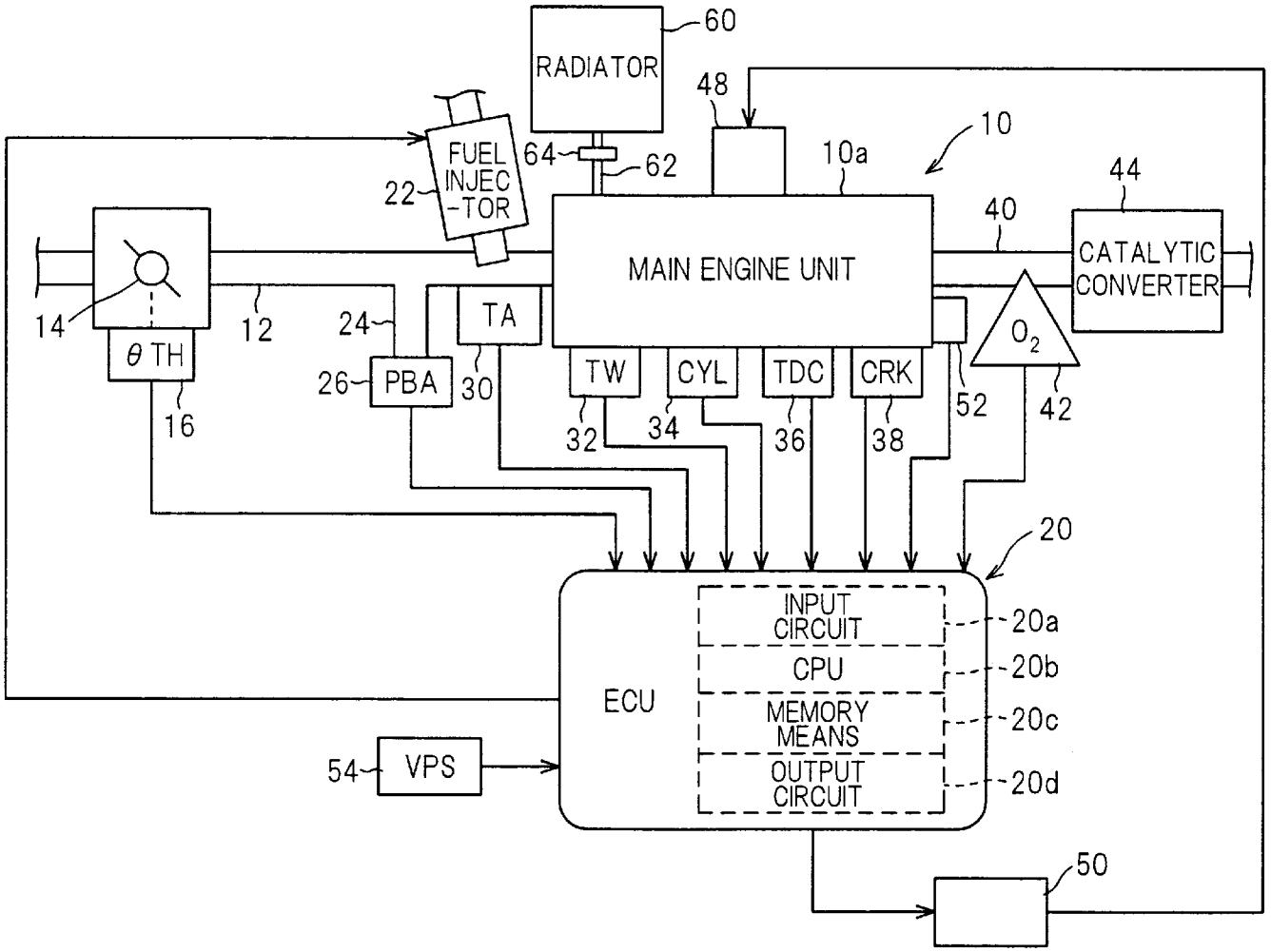
FIG. 1 is an overall schematic view of a system for detecting malfunction of an internal combustion engine radiator according to the invention.

FIG. 1 is an overall schematic view of a system for detecting or discriminating malfunction of an internal combustion engine radiator according to the invention.

Reference numeral 10 in FIG. 1 designates a four-cylinder, four-cycle internal combustion engine. An air intake pipe 12 equipped with a throttle valve 14 is connected to the main engine unit 10a of the engine 10. A throttle position sensor 16 associated with the throttle valve 14 produces and sends to an electronic control unit (ECU) 20 an electric signal representing the opening θ TH of the throttle valve 14.

The air intake pipe 12 is connected to an intake manifold (not shown) downstream of the point where the throttle valve 14 is installed. For each cylinder, a fuel injector 22 is provided in the intake manifold at a point upstream of an intake valve (not shown) of the cylinder.

Each fuel injector 22 is mechanically connected with a fuel pump (not shown), that supplies it with pressurized fuel, and is also electrically connected with the ECU 20. The fuel injector 22 injects (supplies) the pressurized fuel before the intake valve during the period when it is controlled to be open by the ECU 20.

A manifold absolute pressure sensor 26 is connected with the air intake pipe 12 through a branch pipe 24 at a point downstream of the throttle valve 14. The manifold absolute pressure sensor 26 outputs an electric signal representing the absolute manifold pressure PBA in the air intake pipe 12.

An air temperature (intake air temperature) sensor 30 is installed downstream of the absolute pressure sensor 26 for outputting an electric signal representing the air temperature (intake air temperature) TA. A coolant temperature sensor 32 is installed near a coolant passage (not shown) of the engine unit 10*a* for outputting an electric signal representing the engine coolant temperature TW.

A cylinder discrimination sensor 34 is installed in the vicinity of the camshaft or crankshaft (neither shown) of the engine 10 for outputting a cylinder discrimination signal CYL every time a piston (not shown) of a certain cylinder reaches a prescribed position.

A TDC sensor 36 is installed in the vicinity of a camshaft or crankshaft (neither shown) for outputting a TDC signal pulse once every crank angle (e.g., BTDC 10 degrees) associated with the TDC (top dead center) position of the piston of each cylinder. A crank angle (CRK) sensor 38 is similarly installed for outputting CRK signal pulses at a shorter crank angle period (e.g., every 30 degrees) than the period of the TDC signal pulses.

In the exhaust system of the engine 10, an air/fuel ratio ($O_2$) sensor 42 is installed at an appropriate portion of an exhaust pipe 40 connected to an exhaust manifold (not shown). The air/fuel ratio sensor 42 outputs a signal representing the oxygen concentration $O_2$ of the exhaust gas. A three-way catalytic converter 44 is provided downstream of the air/fuel ratio sensor 42 for removing HC, CO and $NO_x$ components from the exhaust gas.

Spark plugs 48 associated with the respective cylinder combustion chambers (not shown) of the engine unit 10 are electrically connected with the ECU 20 through an ignition coil and an igniter 50.

A knock sensor 52 is mounted on the cylinder head (not shown) of the main engine unit 10*a* for outputting a signal representing vibration of the engine 10. Further, a vehicle speed sensor 54 is mounted in the vicinity of the drive shaft (not shown) of the vehicle powered by the engine 10. The vehicle speed sensor 54 outputs a pulse once every unit rotation of the vehicle wheels.

The outputs of these sensors are sent to the ECU 20.

The ECU 20, which is constituted as a microcomputer, comprises an input circuit 20*a* for receiving input signals from the aforesaid sensors and subjecting them to wave shaping, conversion to a prescribed voltage level and conversion from analog to digital form, a CPU (central processing unit) 20*b* for conducting logical operations, a memory means 20*c* for storing processing programs executed by the CPU, processed data and the like, and an output circuit 20*d*.

The output of the knock sensor 52 is sent to a detection circuit (not shown) in the ECU 20, where it is amplified and compared with a knock discrimination level. The CPU 20*b* uses the output of the detection circuit to discriminate whether knock (detonation) occurs in the combustion chambers. The CPU 20*b* also calculates the engine speed NE from the counted number of CRK pulses and calculates the vehicle speed VPS from the counted number of output pulses from the vehicle speed sensor 54.

The CPU 20*b* also retrieves a basic ignition timing based on a predefined map (characteristic) stored in the memory means 20*c* using the detected engine speed NE and the manifold absolute pressure PBA (an engine load parameter) as address data, adjusts the basic ignition timing based on the engine coolant temperature TW and further adjusts (retards) the basic ignition timing if engine knock has been detected.

The CPU 20*b* also determines the quantity of fuel injection in terms of injector open time and drives the fuel injectors 22 through the output circuit 20*d* and a drive circuit (not shown).

A radiator 60 in the engine cooling system is connected to the engine 10.

Figure 2:
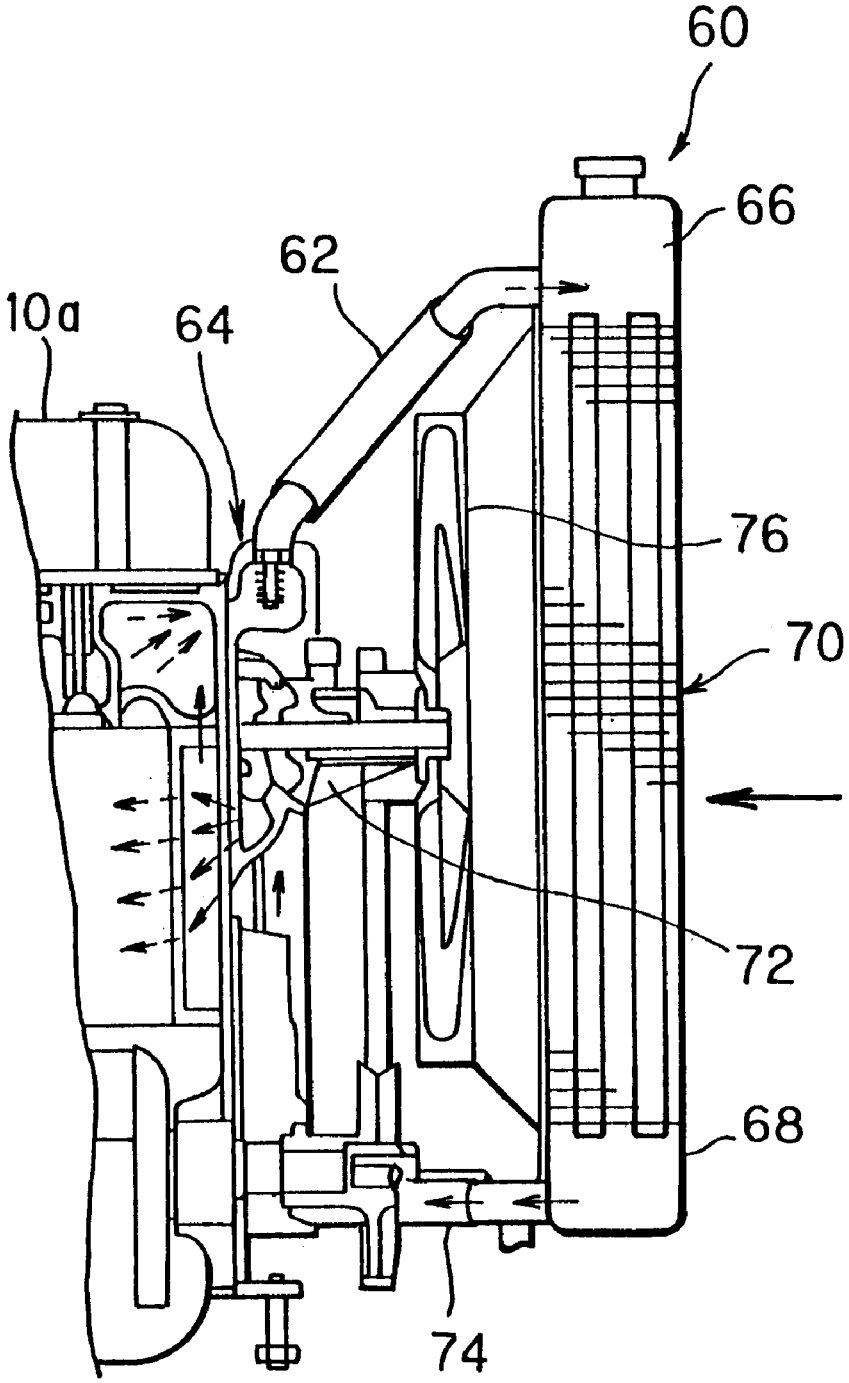
FIG. 2 is an explanatory side sectional view showing the details of the radiator 60 in the engine cooling system illustrated in FIG. 1.

FIG. 2 is an explanatory side sectional view showing the details of the radiator 60.

The radiator 60 is connected to the engine unit 10*a* through an inlet pipe (communicating passage) 62. A thermostat 64 is fitted in the inlet pipe 62.

The radiator 60 has an upper tank 66 at the top, a lower tank 68 at the bottom, and a honeycomb core 70 accommodated in the intervening space. The inlet pipe 62 is connected to the upper tank 66 and an outlet pipe 74 is connected to the lower tank 68. A water pump 72 pressurizes coolant in the coolant passage of the engine unit 10*a* so as to circulate it through the inlet pipe 62, the upper tank 66, the core 70, the outlet pipe 74 and back to the coolant passage of the engine unit 10*a*.

As indicated by an arrow in FIG. 2, the core 70 is cooled by air flowing in from the direction of vehicle travel. A forced flow of cooling air is further produced by a fan 76 located behind the radiator.

The thermostat 64 is a shut-off valve operated by means of a bimetallic strip. At engine starting, when the coolant temperature is low, the thermostat 64 closes the inlet pipe 62 to prevent coolant from flowing into the radiator 60. Then, as the coolant temperature rises, it progressively opens the inlet pipe 62 so that the coolant flows in contact with the core 70 to be cooled and is then returned to the engine coolant passage.

As explained further later, the CPU 20*b* uses the aforesaid sensor outputs to estimate the temperature of the coolant in this arrangement or configuration and, based on the result, determines whether the thermostat 64 has malfunctioned.

This malfunction detection or discrimination will now be explained with reference to the flow chart of FIG. 3. The illustrated program is executed at prescribed intervals of, for example, 2 sec.

First, in S10, it is checked whether the engine 10 is in starting mode. This discrimination or determination is made by first checking whether the starter motor (not shown) is operating and, if it is not, then checking whether the engine speed NE is has reached the cranking speed. If the result of either check is affirmative (Yes), it is determined that the engine 10 is in starting mode.

When the result in S10 is Yes, next, in S12, the values of the totalized engine load for coolant temperature estimation TITTL, the totalized cooling loss CLTTL, the post-engine-starting counter ctTRM (for clocking time elapsed after engine starting), and the totalized vehicle speed VPSTTL are set to zero and the estimated coolant temperature CTW is set to (overwritten with) the value of an engine-start-time estimated coolant temperature TWINIT. These parameters will be explained later.

When the result in S10 is No, it is checked in S14 whether the bit of a flag F_MONTRM is set to 1.

The bit of this flag being set to 1 means that conditions for execution of thermostat malfunction detection or discrimination are established. This flag bit is set by checking whether conditions for execution of thermostat malfunction detection are established in a separate routine.

Figure 4:
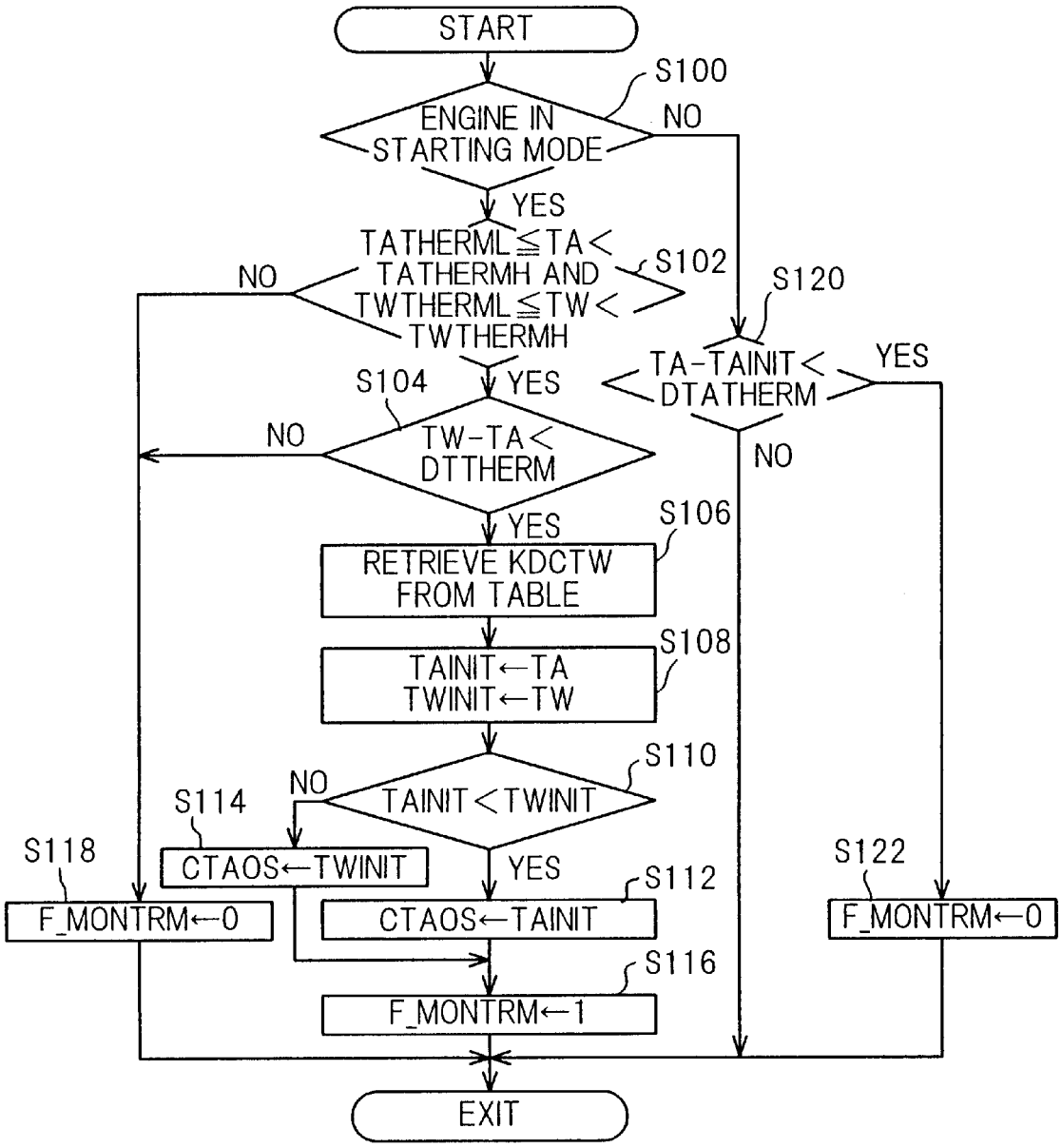
FIG. 4 is a flow chart showing the routine for setting or resetting the bit of a flag indicating whether or not conditions for execution of thermostat malfunction discrimination or detection are established, referred to in the flow chart of FIG. 3.

FIG. 4 is a flow chart showing the routine for determining whether conditions for execution of thermostat malfunction detection are established. This routine is executed once every prescribed crank angle.

In S100, it is checked whether the engine 10 is in starting mode. The method described regarding S10 of FIG. 3 is used.

When the result in S100 is Yes, it is checked in S102 whether the air temperature (intake air temperature) TA detected by the air temperature sensor 30 is equal to or higher than a prescribed value TATHERML (e.g., −7° C.) and lower than a prescribed value TATHERMH (e.g., 50° C.), and whether the coolant temperature TW detected by the coolant temperature sensor 32 is equal to or higher than a prescribed value TWTHERML (e.g., −7° C.) and lower than a prescribed value TWTHERMH (e.g., 50° C.).

When the result in S102 is Yes, then, in S104, the difference between the detected coolant temperature TW and air temperature TA is calculated and it is checked whether the calculated difference is less than a prescribed value DTTHERM (e.g., 10° C.).

Figure 5:
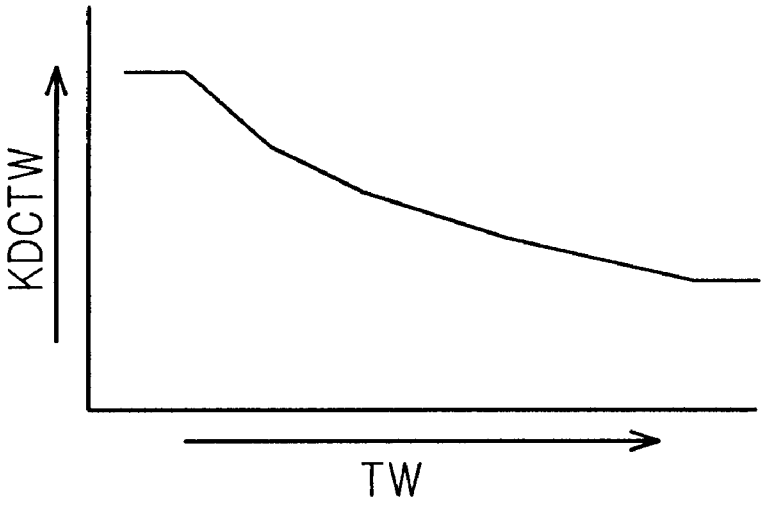
FIG. 5 is an explanatory graph showing the characteristic of a table defining a coolant temperature estimation engine-start-time coolant temperature correction value KDCTW referred to in the flow chart of FIG. 4.

When the result in S104 is Yes, then, in S106, the detected coolant temperature TW is used to retrieve a coolant temperature estimation engine-start-time coolant temperature correction value KDCTW (explained later) from a table compiled based on the characteristic (curve) shown in FIG. 5.

Next, in S108, the engine-start-time detected air temperature TAINIT is overwritten with the air temperature TA and the engine-start-time detected coolant temperature TWINIT is overwritten with the coolant temperature TW.

Next, in S110, it is checked whether the engine-start-time detected air temperature TAINIT is lower than the engine-start-time detected coolant temperature TWINIT. When the result is Yes, CTAOS is overwritten with TAINIT in S112. When the result is No, CTAOS is overwritten with TWINIT in S114.

CTAOS is the corrected engine-start-time air temperature. By these steps, the value of the engine-start-tine air temperature is corrected to the lower of the engine-start-time detected coolant temperature TWINIT and the engine-start-time detected air temperature TAINIT.

Next, in S116, the bit of the flag F_MONTRM is set to 1 to indicate that conditions for execution of thermostat malfunction detection or discrimination are established.

When the result in S102 or S104 is No, the bit of the flag F_MONTRM is reset to 0 in step S118 to indicate that conditions for execution of thermostat malfunction detection or discrimination are not established.

When the result in S100 is No, then, in S120, the difference between the air temperature TA and the engine-start-time detected air temperature TAINIT is calculated and it is checked whether the calculated difference is less than a prescribed value DTATHERM, i.e., whether the decrease in the air temperature is large.

When the result in S120 is Yes, the bit of the flag F_MONTRM is reset to 0 in S122 to indicate that conditions for execution of thermostat malfunction detection or discrimination are not established. If the result is No, S122 is skipped.

As explained further later, in this embodiment thermostat malfunction is discriminated based on the relationship between the detected coolant temperature and the estimated coolant temperature, and since the estimated coolant temperature is calculated from the engine-start-time detected coolant temperature, conditions for execution of thermostat malfunction detection are defined as being established when the engine 10 has cooled to around the air temperature and change in the air temperature is small.

In other words, the conditions are defined as being established when the air temperature and the coolant temperature detected at the time of engine starting are within prescribed ranges (S102) and the detected air temperature does not exceed the detected coolant temperature by more than a prescribed value (S104). Therefore, when the decrease in the detected air temperature after starting is large (S120), it is found that the conditions are not established because not enough time has passed since the vehicle was parked or because the drop in the air temperature was large.

The detection of thermostat malfunction of this embodiment will now be explained. The estimated coolant temperature CTW is calculated from the temperature condition and operating condition at engine starting (S32 in FIG. 3). When the estimated coolant temperature CTW has reached (i.e., is greater than) the judge malfunction value CTWJUD but the detected coolant temperature TW has not reached (i.e., is lower than) the judge normal value TWJUD, the thermostat 64 is discriminated to have malfunctioned (S300 to S308 in FIG. 13).

In S32, the estimated coolant temperature CTW is calculated as:

Estimated coolant temperature CTW=Engine-start-time detected coolant temperature TWINIT (S108 in FIG. 4)+Coolant temperature estimation basic value DDCTW (S30 in FIG. 3)×Coolant temperature estimation engine-start-time coolant temperature correction value KDCTW (S106 in FIG. 4).

Figure 9:
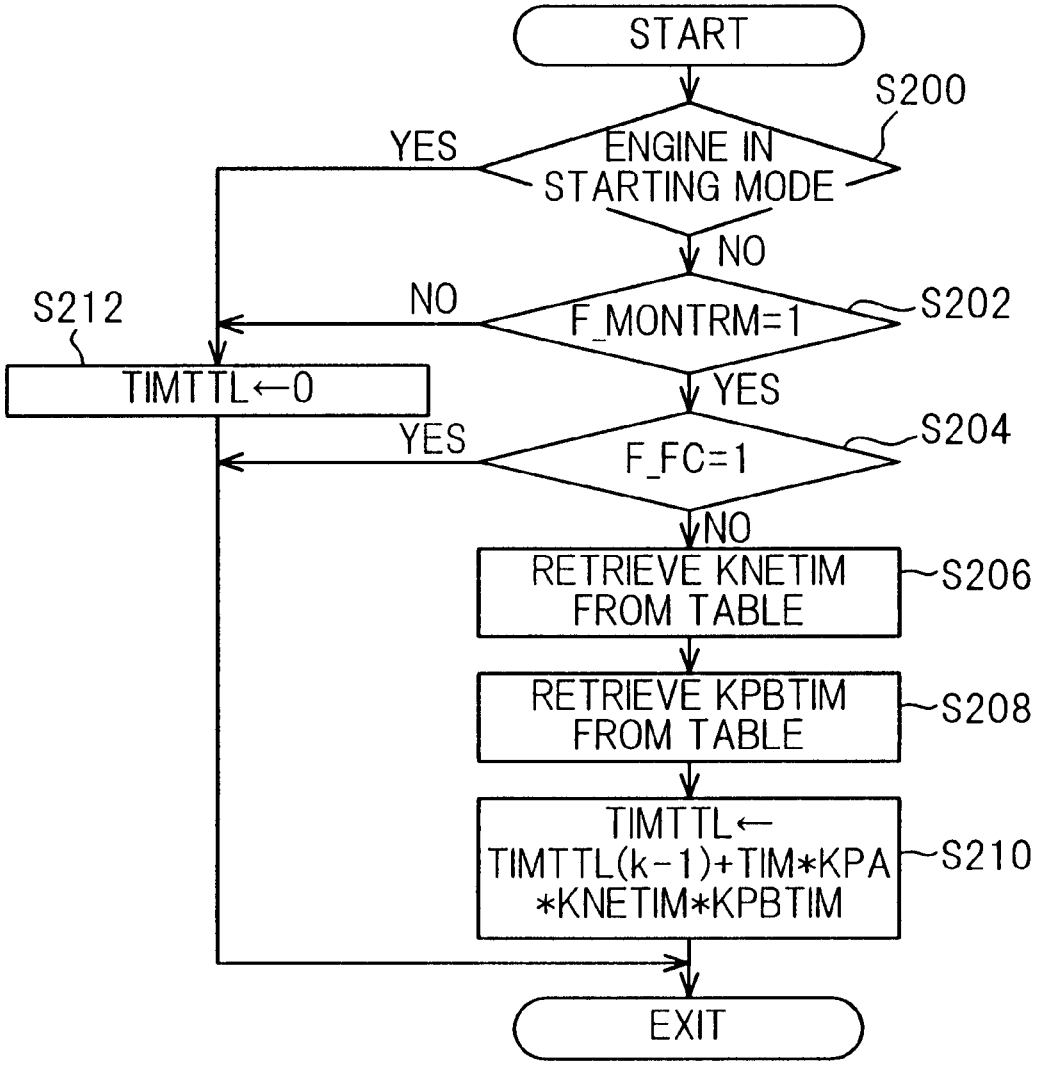
FIG. 9 is a flow chart showing the routine for calculating a totalized engine load TIMTTL which is used as a basic value for calculating a totalized engine load for coolant estimation TITTL referred to in the flow chart of FIG. 3.

The coolant temperature estimation basic value DDCTW increases in proportion to an increase of the thermal load parameter contributing to coolant temperature rise (totalized engine load for coolant temperature estimation TITTL; S28 in FIG. 3 and S200 to S212 in FIG. 9). Based on the results of their studies, the inventors found that the thermal load parameter can be calculated from the totalized engine load TIMTTL and the totalized cooling loss CLTTL (cooling loss owing to passenger compartment heater and wind). (See S26 in FIG. 3.)

Figure 3:
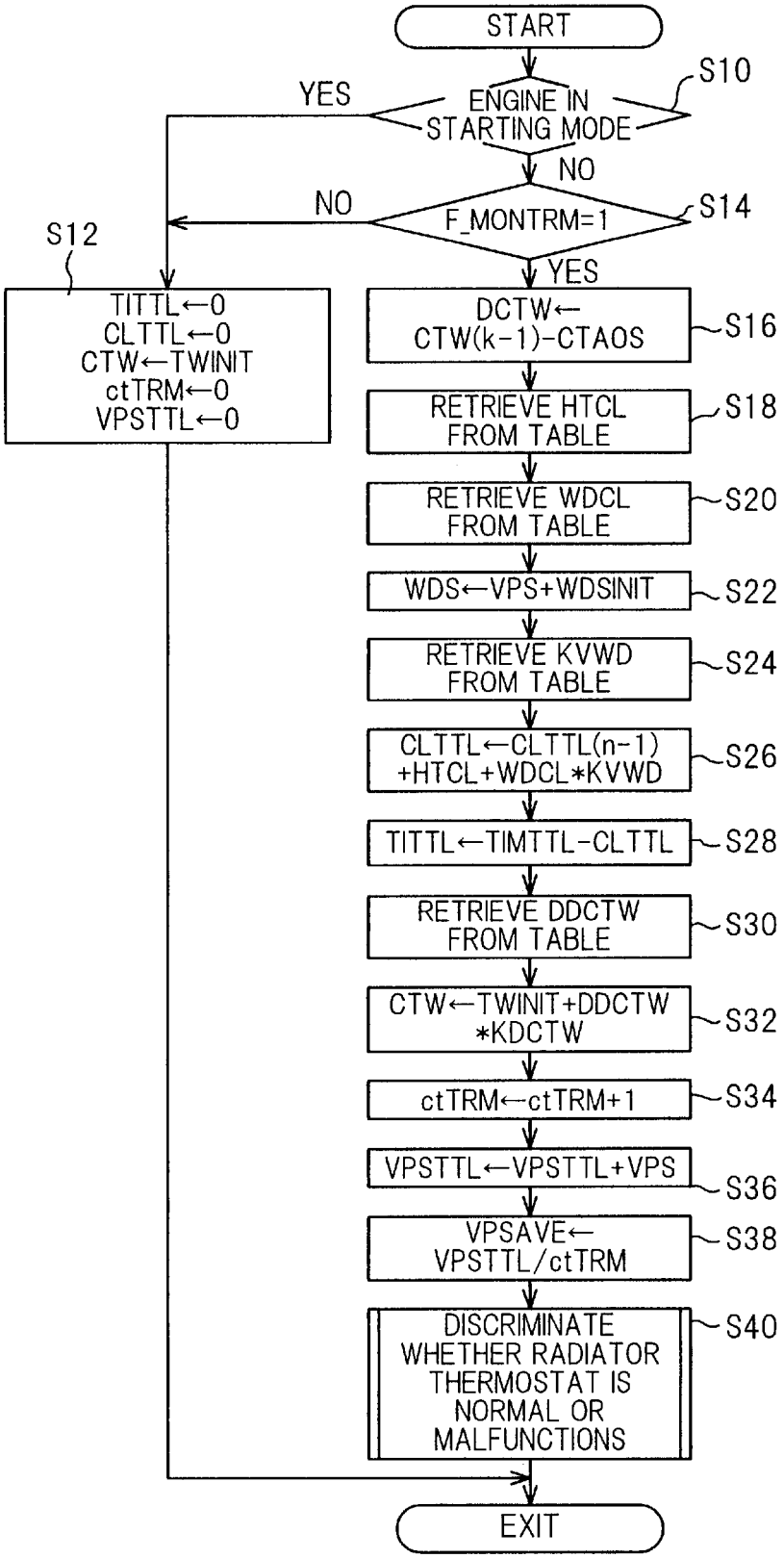
FIG. 3 is a flow chart showing the operation of the system illustrated in FIG. 1.

The explanation of FIG. 3 will be continued. In S14, the bit of the flag determined in the subroutine of FIG. 4 is checked. When the result is affirmative (Yes), i.e., when it has been found that conditions for execution of thermostat malfunction detection or discrimination are established, then, in S16, a difference DCTW is calculated from the estimated coolant temperature in the preceding cycle CTW (k-1) and the corrected engine-start-time air temperature CTAOS (the lower of the engine-start-time detected coolant temperature and the engine-start-time detected air temperature, as determined in S110 to S114).

In this specification and the drawings, the notation (k) indicates a sampling number in a discrete system, i.e., the interval of one activation cycle of the routine of FIG. 3. The notation (k-1) indicates that the value is that in the preceding cycle. (In the interest of simpler notation, (k) is not affixed to current cycle values.)

Figure 6:
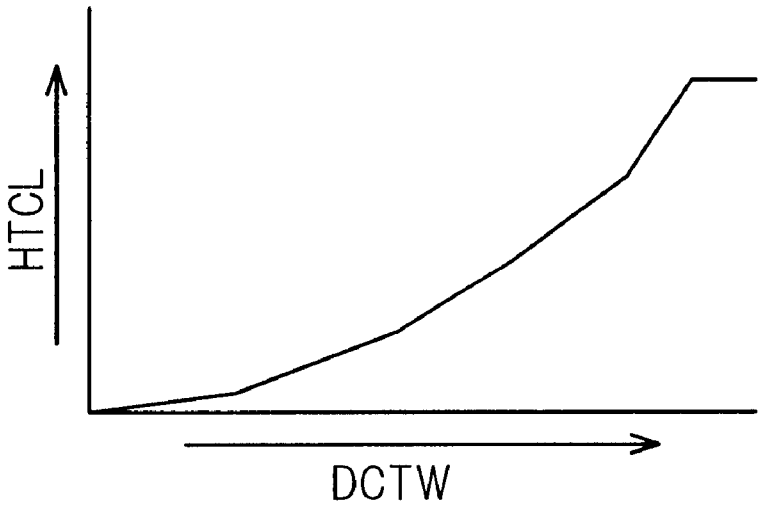
FIG. 6 is an explanatory graph showing the characteristic of a table defining a heater cooling loss HTCL referred to in the flow chart of FIG. 3.

Next, in S18, the difference DCTW is used to retrieve the heater cooling loss HTCL from a table compiled based on the characteristic (curve) shown in FIG. 6. By "heater cooling loss" is meant the loss occurring when high-temperature coolant is used to heat the passenger compartment.

The heater cooling loss HTCL increases in proportion to increase of the difference DCTW between the estimated coolant temperature and the air temperature (lower of the detected coolant temperature and the detected air temperature). It is expressed as a value corresponding to the fuel injection period (quantity of fuel injection) per unit time.

Figure 7:
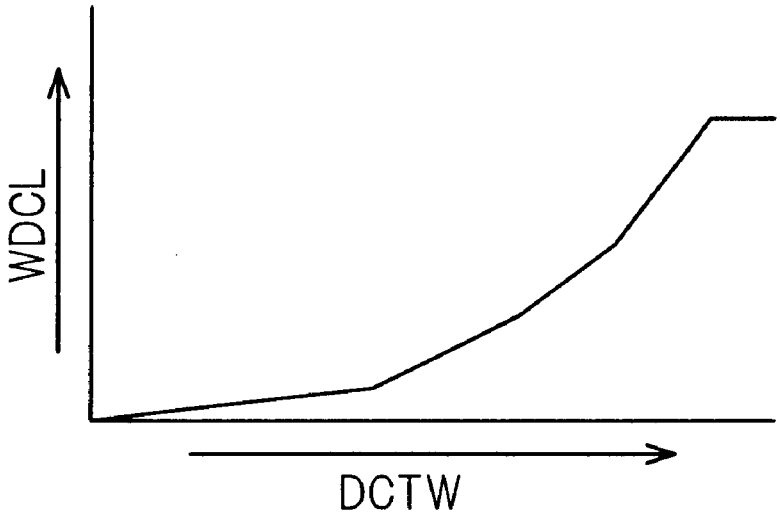
FIG. 7 is an explanatory graph showing the characteristic of a table defining a wind cooling loss WDCL referred to in the flow chart of FIG. 3.

Next, in S20, the difference DCTW is used to retrieve the wind cooling loss WDCL from a table compiled based on the characteristic (curve) shown in FIG. 7.

For any given wind speed, the wind cooling loss WDCL also increases in proportion to increase of the difference DCTW. It is also expressed as a value corresponding to the fuel injection period (quantity of fuel injection) per unit time.

Next, in S22, a wind speed WDSINIT (fixed value) for a time of strong wind is added to the vehicle speed VPS detected by the vehicle speed sensor 54 to calculate an estimated relative wind speed WDS.

Figure 8:
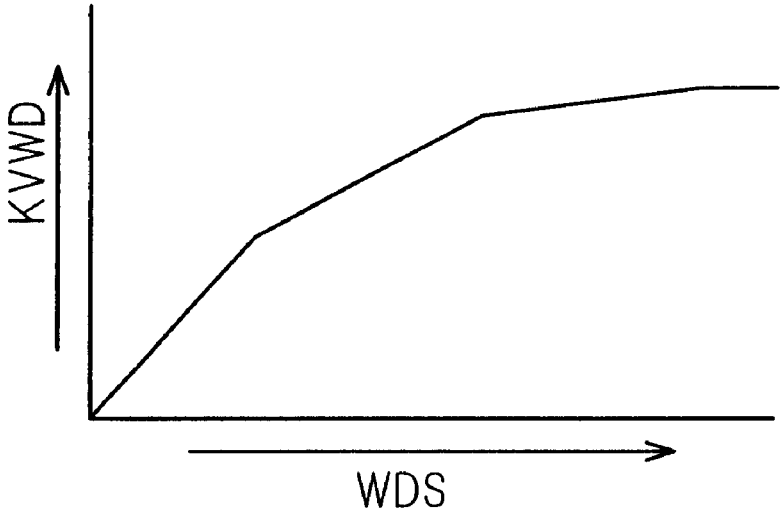
FIG. 8 is an explanatory graph showing the characteristic of a table defining a wind-speed correction value KVWD referred to in the flow chart of FIG. 3.

Next, in S24, the estimated relative wind speed WDS is used to retrieve a wind-speed correction value KVWD from a table compiled based on the characteristic (curve) shown in FIG. 8.

Next, in S26, the totalized cooling loss CLTTL is calculated.

Specifically, the product of the wind cooling loss WDCL and the wind-speed correction value KVWD is added to the calculated heater cooling loss HTCL, the result is added to (used to update) the preceding-cycle totalized cooling loss CLTTL(k-1), and the sum is defined as the current-cycle totalized cooling loss CLTTL.

Next, in S28, the totalized engine load for coolant temperature estimation TITTL is calculated.

This is calculated, as will be described later, based on the totalized engine load TIMTTL etc. The totalized engine load TIMTTL is calculated using the routine shown in FIG. 9, which is executed at a certain crank angle such as TDC.

First, in S200, the technique explained with reference to S10 is used to check whether the engine 10 is in starting mode. When the result is No, it is checked in S202 whether the bit of the thermostat malfunction detection conditions established flag F_MONTRM is set to 1, i.e., whether conditions for execution of thermostat malfunction detection or discrimination are established.

Figure 10:
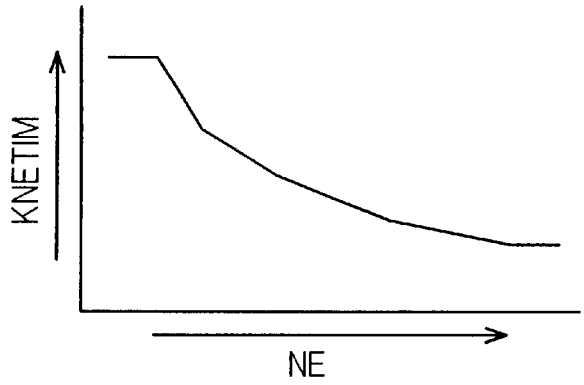
FIG. 10 is an explanatory graph showing the characteristic of a table defining an engine speed correction value KNETIM referred to in the flow chart of FIG. 9.

When the result in S202 is Yes, it is checked in S204 whether the bit of a flag F_FC is set to 1, i.e., whether fuel cutoff in effect. When the result is No, then, in S206, the detected engine speed NE is used to retrieve an engine speed correction value KNETIM from a table compiled based on the characteristic (curve) shown in FIG. 10.

Figure 11:
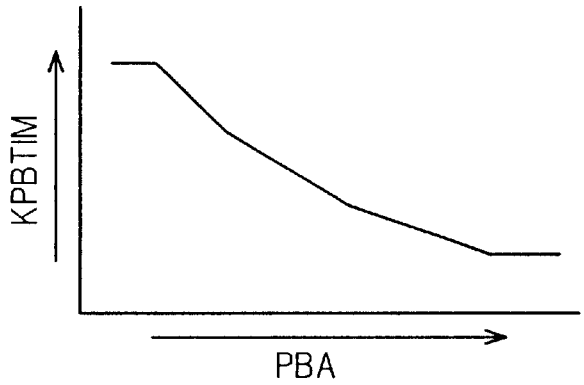
FIG. 11 is an explanatory graph showing the characteristic of a table defining a load correction value KPBTIM referred to in the flow chart of FIG. 9.

Next, in S208, the detected manifold absolute pressure PBA is used to retrieve a load correction value KPBTIM from a table compiled based on the characteristic (curve) shown in FIG. 11, whereafter the totalized engine load TIMTTL is calculated in S210.

Specifically, the product of a multiplication correction term KPA, the calculated engine speed correction value KNETIM, and the load correction value KPBTIM and a basic fuel injection period (quantity of fuel injection) TIM, is added to (used to update) the preceding totalized engine load TIMTTL(k-1), and the sum is defined as the totalized engine load TIMTTL.

When the result in S200 is Yes or the result in S202 is No, accurate calculation of the totalized engine load is difficult, so the value of the totalized engine load is set to zero in S212. When the result in S204 is Yes, the remaining steps are skipped because fuel is not being injected.

The explanation of FIG. 3 will be continued. In S28, the totalized engine load for coolant temperature estimation TITTL is calculated based on the so-calculated totalized engine load.

Specifically, the totalized cooling loss CLTTL is subtracted from the calculated totalized engine load TIMTTL and the difference is defined as the totalized engine load for coolant temperature estimation TITTL.

Figure 12:
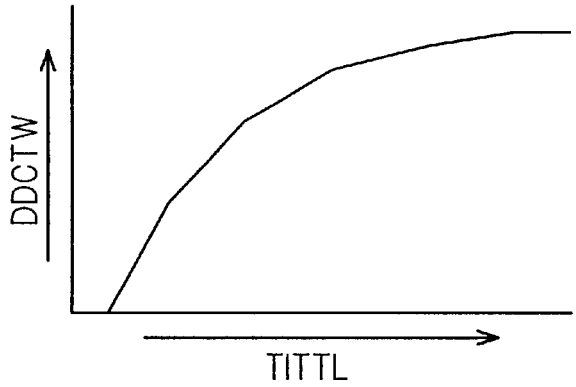
FIG. 12 is an explanatory graph showing the characteristic of a table defining a coolant temperature estimation basic value DDCTW referred to in the flow chart of FIG. 3.

Next, in S30, the calculated totalized engine load for coolant temperature estimation TITTL is used to retrieve the coolant temperature estimation basic value DDCTW from a table compiled based on the characteristic (curve) shown in FIG. 12, whereafter the final estimated coolant temperature CTW is determined in S32.

Specifically, the product of coolant temperature estimation basic value DDCTW and the coolant temperature estimation engine-start-time coolant temperature correction value KDCTW (calculated in S106 of FIG. 4) is added to the engine-start-time detected coolant temperature TWINIT, and the sum is defined as the estimated coolant temperature CTW.

The value of the post-engine-starting counter ctTRM is then incremented by 1 in S34. Next, in S36, the totalized vehicle speed VPSTTL is updated by adding the vehicle speed VPS detected in the current cycle thereto.

Next, in S38, a post-engine-starting average vehicle speed VPSAVE is calculated by dividing the updated totalized vehicle speed VPSTTL by the post-engine-starting counter ctTRM.

Next, S40, it is discriminated or detected whether the thermostat 64 is normal or malfunctions (faulty).

Figure 13:
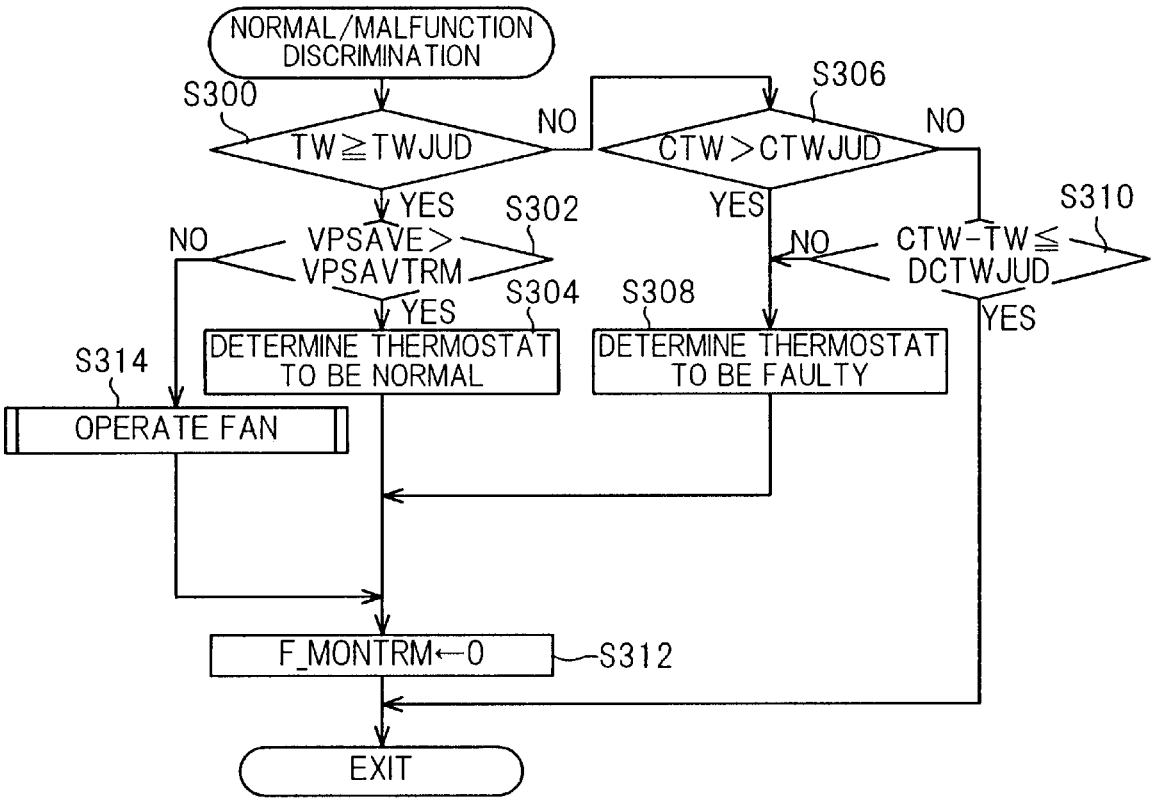
FIG. 13 is a flow chart showing the subroutine for discrimination or detection of whether the radiator thermostat is normal or malfunctions, referred to in the flow chart of FIG. 3.

The subroutine for this is shown in FIG. 13.

First, in S300, it is checked whether the coolant temperature TW detected by the coolant temperature sensor 32 is equal to or greater than the judge normal value TWJUD (e.g., 70° C.). When the result is Yes, it is checked in S302 whether the average vehicle speed VPSAVE exceeds a reference value VPSAVTRM (e.g., 30 km/h). When the result is Yes, the thermostat 64 is determined to be normal in S304.

When the result in S300 is No (in other words when TW is lower than TWJUD), it is checked in S306 whether the estimated coolant temperature CTW is greater than the judge malfunction value CTWJUD (e.g., 75° C.). When the result in S306 is Yes, the thermostat 64 is determined to be faulty in S308, i.e., to have experienced a malfunction such as excessive leakage, too low valve opening temperature or open-state sticking.

When the result in S306 is No, it is checked in S310 whether the difference obtained by subtracting the detected coolant temperature TW from the estimated coolant temperature CTW is equal to or less than a second judge malfunction value DCTWJUD (e.g., 15° C.). When the result is No, the thermostat is determined to be faulty in S308.

Thus, when the estimated coolant temperature reaches the judge malfunction value before the detected coolant temperature reaches the judge normal value, thermostat malfunction is determined. On the other hand, when the estimated coolant temperature is much higher than the detected coolant temperature, thermostat malfunction is determined even before the estimated coolant temperature reaches the prescribed value.

When the thermostat is found to be normal, the bit of the flag F_MONTRM is reset to 0 in S312.

When the result in S302 is No, i.e., when it is found that the radiator 60 is exposed to little wind owing to low vehicle speed (average vehicle speed), the discrimination or detection is delayed. This is to avoid a discrimination or detection error that might arise because under such a condition the coolant temperature rises rapidly even if the thermostat 64 is not actually faulty.

Specifically, when the result is No in S302, a separate subroutine not shown in the drawings is activated in S314. In this subroutine, the fan 76 is forcibly operated for a prescribed time period to cool the radiator 60 and then, after elapse of the prescribed time period, the coolant temperature TW and the judge normal value TWJUD are compared, whereafter the thermostat is determined to be normal when the coolant temperature TW is equal to or higher than the judge normal value TWJUD and is judged to be faulty when the coolant temperature TW is lower than the judge normal value TWJUD.

As explained in the foregoing, this embodiment is configured so that malfunction of the radiator is concluded to have occurred also when the estimated coolant temperature reaches the judge malfunction value before the detected coolant temperature reaches the judge normal value (or even before the estimated coolant temperature reaches the prescribed value if the estimated coolant temperature is much higher than the detected coolant temperature).

Specifically, an estimated coolant temperature is calculated from the coolant temperature at engine starting and thermal load parameters simulating radiator operation or approximating the radiator behavior, the actual coolant temperature is detected, the estimated and actual coolant temperatures are compared with predetermined values, and presence/absence of thermostat malfunction is determined by discriminating the temperature rise characteristics of the two. Thermostat malfunctions such as excessive leakage, too low valve opening temperature and open-state sticking can therefore be detected with high accuracy and good response.

This embodiment is thus configured to have a system for detecting malfunction of a radiator connected to an internal combustion engine (10) through a communicating passage (the inlet pipe 62) for cooling a coolant of the engine, the radiator having a thermostat (64) which closes or opens the communicating passage, comprising: engine operating condition detecting means (the crank angle sensor 38, the manifold absolute pressure sensor 26, the coolant temperature sensor 32, the intake air temperature sensor 30, the vehicle speed sensor 54, the ECU 20) for detecting operating conditions of the engine (i.e., the engine speed NE, the manifold pressure PBA, the intake air temperature TA, the vehicle speed VPS) including at least a coolant temperature (TW); engine-start-time coolant temperature determining means (ECU 20, S108–S114) for determining an engine-start-time coolant temperature (TWINIT, CTAOS) at starting of the engine based on at least the detected coolant temperature (TW); thermal load parameter determining means (ECU 20, S26–S28, S200–S212) for determining a parameter indicative of thermal load contributing to a rise of the coolant temperature (TITTL) based on the detected engine operating conditions; estimated coolant temperature calculating means (ECU 20, S30–S32, S200–S212 (for calculating an estimated coolant temperature (CTW) based on at least the determined engine-start-time coolant temperature and the determined parameter indicative of thermal load; and radiator malfunction discriminating means (ECU 20, S40, S300–S308) for comparing the detected coolant temperature (TW) and the calculated estimated coolant temperature (CTW) with predetermined values (TWJUD, CTWJUD) respectively and for discriminating whether the radiator (60, i.e., the thermostat 64) malfunctions based results of comparison.

In the system, the thermal load parameter determining means determines the parameter indicative of thermal load based on at least a totalized engine load (TIMTTL).

In the system, the thermal load parameter determining means determines the totalized engine load based on at least a quantity of fuel injection to be supplied to the engine (TIM×KPA), a speed of the engine (NE) and a load of the engine (PBA).

In the system, the thermal load parameter determining means determines a wind cooling loss (CLTTL) and adjusts the totalized engine load by the determined totalized cooling loss.

In the system, the thermal load parameter determining means determines the wind cooling loss based on at least air temperature (TA, i.e., CTAOS) and a speed of a vehicle on which the engine is mounted (VPS).

In the system, the radiator malfunction discriminating means includes; detected coolant temperature comparing means for comparing the detected coolant temperature (TW) with a first one of the predetermined values (TWJUD); and calculated estimated coolant temperature comparing means for comparing the calculated estimated temperature (CTW) with a second one of the predetermined values (CTWJUD); and discriminates that the radiator malfunctions when the detected coolant temperature is determined to be lower than the first one of the predetermined values (S300) and the calculated estimated temperature is determined to be greater than the second one of the predetermined values (S306).

In the system, the radiator malfunction discriminating means includes; difference calculating means (S310) for calculating a difference (CTW−TW) between the detected coolant temperature and the calculated estimated coolant temperature and difference comparing means for comparing the difference with a third one of the predetermined values (DCTWJUD); and discriminates that the radiator malfunctions when the detected coolant temperature is determined to be lower than the first one of the predetermined values (S300 and the calculated estimated temperature is determined to be not greater than the second one of the predetermined values (S306), but the difference is determined to be greater than the third one of the predetermined values (S310).

The system further includes: malfunction discrimination condition detecting means (ECU 20, S14, S100–S122) for detecting whether conditions for execution of radiator malfunction discrimination are established; wherein the radiator malfunction discriminating means discriminates whether the radiator malfunctions when the conditions for execution of radiator malfunction discrimination are established.

In the system, the malfunction discrimination condition detecting means detects that the conditions for execution of radiator malfunction discrimination are established when the engine is determined to be cooled to around an air temperature and change in the air temperature is small.

In the system, the radiator malfunction discriminating means discriminates whether the thermostat (64) of the radiator malfunctions.

Although the invention has thus been shown and described with reference to specific embodiments, it should be noted that the invention is in no way limited to the details of the described arrangements but changes and modifications may be made without departing from the scope of the invention which is defined by the appended claims.

What is claimed is:

1. A system for detecting malfunction of a radiator connected to an internal combustion engine through a communicating passage for cooling a coolant of the engine, the radiator having a thermostat which closes or opens the communicating passage, comprising:

engine operating condition detecting means for detecting operating conditions of the engine including at least a coolant temperature;

engine-start-time coolant temperature determining means for determining an engine-start-time coolant temperature at starting of the engine based on at least the detected coolant temperature;

thermal load parameter determining means for determining a parameter indicative of thermal load contributing to a rise of the coolant temperature based on the detected engine operating conditions;

estimated coolant temperature calculating means for calculating an estimated coolant temperature based on at least the determined engine-start-time coolant temperature and the determined parameter indicative of thermal load; and radiator malfunction discriminating means for comparing the detected coolant temperature and the calculated estimated coolant temperature with predetermined values respectively and for discriminating whether the radiator malfunctions based results of comparison.

2. A system according to claim 1, wherein the thermal load parameter determining means determines the parameter indicative of thermal load based on at least a totalized engine load.

3. A system according to claim 2, wherein the thermal load parameter determining means determines the totalized engine load based on at least a quantity of fuel injection to be supplied to the engine, a speed of the engine and a load of the engine.

4. A system according to claim 2, wherein the thermal load parameter determining means determines a wind cooling loss and adjusts the totalized engine load by the determined totalized cooling loss.

5. A system according to claim 4, wherein the thermal load parameter determining means determines the wind cooling loss on at least air temperature and a speed of a vehicle on which the engine is mounted.

6. A system according to claim 1, wherein the radiator malfunction discriminating means includes;

detected coolant temperature comparing means for comparing the detected coolant temperature with a first one of the predetermined values; and calculated estimated coolant temperature comparing means for comparing the calculated estimated temperature with a second one of the predetermined values;

and discriminates that the radiator malfunctions when the detected coolant temperature is determined to be lower than the first one of the predetermined values and the calculated estimated temperature is determined to be greater than the second one of the predetermined values.

7. A system according to claim 6, wherein the radiator malfunction discriminating means includes;

difference calculating means for calculating a difference between the detected coolant temperature and the calculated estimated coolant temperature; and difference comparing means for comparing the difference with a third one of the predetermined values;

and discriminates that the radiator malfunctions when the detected coolant temperature is determined to be lower than the first one of the predetermined values and the calculated estimated temperature is determined to be not greater than the second one of the predetermined values, but the difference is determined to be greater than the third one of the predetermined values.

8. A system according to claim 1, further including:

malfunction discrimination condition detecting means for detecting whether conditions for execution of radiator malfunction discrimination are established;

and wherein the radiator malfunction discriminating means discriminates whether the radiator malfunctions when the conditions for execution of radiator malfunction discrimination are established.

9. A system according to claim 8, wherein the malfunction discrimination condition detecting means detects that the conditions for execution of radiator malfunction discrimination are established when the engine is determined to be cooled to around an air temperature and a change in the air temperature is small.

10. A system according to claim 1, wherein the radiator malfunction discriminating means discriminates whether the thermostat of the radiator malfunctions.

11. A method of detecting malfunction of a radiator connected to an internal combustion engine through a communicating passage for cooling a coolant of the engine, the radiator having a thermostat which closes or opens the communicating passage, comprising the steps of:

detecting operating conditions of the engine including at least a coolant temperature;

determining an engine-start-time coolant temperature at starting of the engine based on at least the detected coolant temperature;

determining a parameter indicative of thermal load contributing to a rise of the coolant temperature based on the detected engine operating conditions;

calculating an estimated coolant temperature based on at least the determined engine-start-time coolant temperature and the determined parameter indicative of thermal load; and comparing the detected coolant temperature and the calculated estimated coolant temperature with predetermined values respectively and for discriminating whether the radiator malfunctions based results of comparison.

12. A method according to claim 11, wherein the parameter indicative of thermal load is determined based on at least a totalized engine load.

13. A method according to claim 12, wherein the totalized engine load is determined based on at least a quantity of fuel injection to be supplied to the engine, a speed of the engine and a load of the engine.

14. A method according to claim 12, wherein a wind cooling loss is determined and the totalized engine load is adjusted by the determined totalized cooling loss.

15. A method according to claim 14, wherein the wind cooling loss is determined based on at least air temperature and a speed of a vehicle on which the engine is mounted.

16. A method according to claim 11, wherein the radiator malfunction discriminating step includes the steps of;

comparing the detected coolant temperature with a first one of the predetermined values; and comparing the calculated estimated temperature with a second one of the predetermined values;

and discriminating that the radiator malfunctions when the detected coolant temperature is determined to be lower than the first one of the predetermined values and the calculated estimated temperature is determined to be greater than the second one of the predetermined values.

17. A method according to claim 16, wherein the radiator malfunction discriminating step includes the steps of;

calculating a difference between the detected coolant temperature and the calculated estimated coolant temperature; and comparing the difference with a third one of the predetermined values;

and discriminating that the radiator malfunctions when the detected coolant temperature is determined to be lower than the first one of the predetermined values and the calculated estimated temperature is determined to be not greater than the second one of the predetermined values, but the difference is determined to be greater than the third one of the predetermined values.

18. A method according to claim 11, further including the step of:

detecting whether conditions for execution of radiator malfunction discrimination are established;

and wherein discriminating whether the radiator malfunctions when the conditions for execution of radiator malfunction discrimination are established.

19. A method according to claim 18, wherein detecting that the conditions for execution of radiator malfunction discrimination are established when the engine is determined to be cooled around an air temperature and change in the air temperature is small.

20. A method according to claim 11, wherein discriminating whether the thermostat of the radiator malfunctions.

* * * * *